US012116769B2

(12) United States Patent
Beach

(10) Patent No.: US 12,116,769 B2
(45) Date of Patent: Oct. 15, 2024

(54) CONNECTOR DEVICE, SYSTEM AND METHOD FOR CONSTRUCTING A ROOF FOR A BUILDING

(71) Applicant: Steven Robert Beach, Varna, IL (US)

(72) Inventor: Steven Robert Beach, Varna, IL (US)

( * ) Notice: Subject to any disclaimer, the term of this patent is extended or adjusted under 35 U.S.C. 154(b) by 0 days.

(21) Appl. No.: 18/098,936

(22) Filed: Jan. 19, 2023

(65) Prior Publication Data

US 2023/0193618 A1 Jun. 22, 2023

Related U.S. Application Data

(62) Division of application No. 17/557,420, filed on Dec. 21, 2021, now Pat. No. 12,012,746.

(51) Int. Cl.

| | |
|---|---|
| ***E04B 1/26*** | (2006.01) |
| ***E04B 1/38*** | (2006.01) |
| ***E04B 1/41*** | (2006.01) |

(52) U.S. Cl.

CPC ..... *E04B 1/2608* (2013.01); *E04B 1/388* (2023.08); *E04B 2001/389* (2023.08)

(58) Field of Classification Search

CPC ..... E04B 1/40; E04B 1/2608; E04B 2001/405
USPC ..... 52/272
See application file for complete search history.

(56) References Cited

U.S. PATENT DOCUMENTS 1,562,784 A * 11/1925 Olsen ..... E04B 1/4171 52/715
3,256,030 A 6/1966 Banse
3,967,908 A * 7/1976 Snow ..... E04B 1/2608 403/231
D256,663 S 9/1980 Gilb
D260,481 S * 9/1981 Norcross ..... D8/394
D265,051 S * 6/1982 Hentzschel ..... D8/380
4,410,294 A * 10/1983 Gilb ..... F16B 9/052 403/403
4,414,785 A * 11/1983 Howell ..... E04B 1/2608 52/713
5,004,369 A * 4/1991 Young ..... E04B 7/063 403/402
5,217,317 A * 6/1993 Young ..... F16B 9/052 403/14
5,230,198 A * 7/1993 Callies ..... F16B 9/058 52/696
5,274,973 A * 1/1994 Liang ..... E04B 2/58 52/317
5,307,603 A * 5/1994 Chiodo ..... E04B 1/2608 52/297
5,335,469 A 8/1994 Stuart
D364,794 S * 12/1995 Eberschlag ..... D8/354
5,488,810 A * 2/1996 Horton ..... F16B 9/058 52/715

(Continued)

*Primary Examiner* — James J Buckle, Jr.
(74) *Attorney, Agent, or Firm* — Scherrer Patent & Trademark Law, P.C.; Stephen T. Scherrer; Monique A. Morneault

(57) ABSTRACT

The present disclosure relates to connecting devices and systems for constructing a structure. Specifically, the present disclosure relates to a connector device and system useful for joining structural elements together for constructing a roof on a building. The present disclosure provides embodiments of connectors which are used to secure roof purlins to rafters and/or trusses to enhance the structural integrity of the roof.

11 Claims, 16 Drawing Sheets

(56) References Cited

U.S. PATENT DOCUMENTS

| | | | | |
|---|---|---|---|---|
| 5,699,639 | A * | 12/1997 | Fernandez | E04B 7/045 52/707 |
| 6,209,268 | B1 | 4/2001 | Schmidt | |
| 6,691,487 | B2 * | 2/2004 | Daudet | E04C 3/09 52/220.8 |
| 7,316,098 | B1 | 1/2008 | Sackett | |
| 7,856,763 | B2 | 12/2010 | Keys et al. | |
| D667,718 | S * | 9/2012 | Preda | D8/354 |
| 9,650,780 | B2 | 5/2017 | Tan | |
| 10,100,508 | B1 | 10/2018 | Fox | |
| 10,202,766 | B1 | 2/2019 | Fox | |
| 10,273,678 | B2 | 4/2019 | Hensen et al. | |
| 10,280,617 | B2 | 5/2019 | Monty et al. | |
| 10,358,811 | B1 | 7/2019 | Fox | |
| 10,550,570 | B2 * | 2/2020 | Burt | E04B 1/2403 |
| 11,028,580 | B2 * | 6/2021 | Burt | E04B 1/003 |
| 2003/0009980 | A1 | 1/2003 | Shahnazarian | |
| 2004/0103597 | A1 * | 6/2004 | Ellenberger | E04B 7/24 52/90.2 |
| 2005/0155315 | A1 | 7/2005 | Davis et al. | |
| 2016/0177560 | A1 * | 6/2016 | Hensen | E04B 1/2608 52/272 |
| 2016/0186424 | A1 * | 6/2016 | Meyer | E04B 1/24 52/702 |
| 2019/0271147 | A1 | 9/2019 | Hensen et al. | |

* cited by examiner

CONNECTOR DEVICE, SYSTEM AND METHOD FOR CONSTRUCTING A ROOF FOR A BUILDING

TECHNICAL FIELD

The present invention relates to a connecting device, system and method for constructing a structure. Specifically, the device is a connector or bracket for use in connecting the structural elements of a roof, including connecting purlins to the truss or rafters in the construction of a roof for a building, including a post frame building. The present connecting device also provides reinforcement to roof connection points, while avoiding the inherent weakness in structure created by traditional fastening devices and methods. The present connecting device improves the efficiency in construction of a roof structure, including permitting installation of the device and assembly of roof trusses at ground level prior to installation, thereby avoiding performing these tasks at heights above the ground.

BACKGROUND

It is well-known in the construction, architectural and building industries that constructing a strong roof is a must for any structure. Components of a roof structure generally include rafters extending downward from a central ridge board, purlins running horizontally above the rafters and joists, which create the roof framing surface running the width of the roof structure and perpendicular to the rafters. Alternately, trusses may be used in place of rafters. Proper connection of each of these structural components is important for the strength and longevity of the resulting roof structure.

Purlins are longitudinal structural members running horizontally above and connected to the rafters. Purlins contribute to the structural support of the roof and assist in maintain the integrity of the roof sheeting, which is attached to the purlins. Purlins further support the rafters, which are the sloping beams extending from the central ridge and joined to walls of the building. A purlin should be strong enough to withstand loads, such as snow and wind, which it will encounter during the life of the roof and should not weaken or sag in an obvious manner that would give the roof sheeting an undulating and/or uneven appearance.

During construction of a roof, the roof purlins are connected to the truss or rafters on an edge, or upright, while other purlins are installed with the boards laid flat. The current industry standard for fastening purlins on edge would be to drive a 6 inch 60 d ring shank nail lengthwise through the purlin and into the truss or rafter below, while the current industry standard for fastening purlins laid flat would be to drive or air-nail multiple 3 inch 16 d ring shank nails through the purlin and into the truss or rafter below.

However, this type of traditional fastener and connection method results in several problems. A first problem is that driving a long nail into and through a 3.5 inch purlin and then into a truss is difficult. Oftentimes, the nail will not drive straight, which may cause the nail to miss the target or push out the side of the truss, rafter or framing member. The result is a weak and unsightly connection. Wood grain, knots, and other imperfections in the wood members increase the risk of misalignment, which may result in the boards to split or splinter. The weak connection will decrease the overall wind load of the structure, increasing the risk of wind damage. Additionally, this connection task is often performed at varying heights, meaning the worker is up on the roof structure, which further increases the difficulty of the task.

A second problem is that the roof purlins are limited in length, so they must be joined together at certain points along the building's length. The common method is to overlap the purlins at the truss connection point. The problem with this method is that the purlins are now misaligned or staggered. This increases the difficulty of properly fastening the roof sheeting to the purlin where the stagger occurs, and also increases the risk for roof leaks increases due to the fastener missing the purlin below. This method also limits the number of fasteners which can be used to fasten the purlin to the truss, as installing multiple 60 d nails in such close proximity, will often cause the truss member to split, weakening the connection even further. This type of connection is also not visually appealing and provides a "cluttered" appearance to the framing. Additionally, a builder may be required to stagger the joints of the purlins, further complicating the construction process while still maintaining a weak connection point.

A third problem is that in buildings with an overhang, which extends beyond the exterior wall of the building, will be subject to forces from high winds placed on the connection point of the overhang. Limited fasteners and lumber that has been split or splintered offer minimal pull-out resistance and are often the cause of roof failure. The risk of splitting or splintering is increased on buildings with no overhang, as the purlin is fastened at the very end of the board, which is prone to this type of damage.

A need, therefore, exists for an improved connector device or bracket for constructing and reinforcing a structure, and in particular a roof structure. Specifically, a need exists for improved devices and systems for use in roof construction.

Moreover, a need exists for an improved connector device for connecting roof purlins to the truss or rafter in the construction of a roof for a building. Specifically, a need exists for a purlin connector designed to install a purlin in a specific position based on the desired connection, for example, either on edge or upright position, or in a flat or horizontal position.

Additionally, a need exists for an improved connector device and system for providing a more secure connection of roof purlins to trusses or rafters for a building.

A need further exists for an improved connector device and system requiring fewer fasteners resulting in a more efficient and stronger connection, as fewer fasteners results in potentially fewer weakened or split places in the framing member.

A need further exists for efficiently connecting multiple purlins to each other and/or to a rafter without the need for splicing or overlapping the purlins.

A need further exists for an improved connector and system providing improved wind damage resistance to the roof structure.

Additionally, a need exists for a connector device for securing a purlin to an end rafter or truss without the connector extending beyond an end of the rafter or truss.

A need further exists for an improved connector and system that permits construction of the initial roof structure, such as a truss, at ground level thereby eliminating the need for temporary bracing.

SUMMARY

The present disclosure relates to an improved device, system and method for constructing and reinforcing a structure, in particular a roof structure. Specifically, the present disclosure relates to a connector or bracket useful for connecting roof purlins to trusses or rafters in the construction of a roof for a building. The present disclosure provides embodiments of connectors useful for securing purlins in different positions and in relation to the rafter or truss. For example, in one embodiment, a purlin connector is provided to install a purlin on edge or upright position. In another embodiment, a purlin connector is provided for installing a purlin installed in a flat or horizontal position. Additional embodiments of various connectors are also provided.

To this end, in an embodiment of the present disclosure, a device for use in constructing a structural element of a building, specifically a roof, is provided. In one embodiment, the device is a connector for joining two structural elements, such as purlins, rafters and trusses together in a perpendicular arrangement for roof construction. The connector comprises a base having a center section with a first longitudinal edge and a second longitudinal edge, a first side panel connected to the first edge of the center section, a second side panel connected to the second edge of the center section, a first wing extending from a top of the first edge of the center section and positioned perpendicular to the first side panel, a second wing extending from a top of the second edge of the center section and positioned perpendicular to the second side panel. This particular connector device embodiment is useful for connecting and installing purlins in an upright or "on edge" position.

In another embodiment, a connector device for constructing a roof is provided. The connector comprises a base having opposing side walls connected by a center section, an opening within the center section, the opening having a first edge and a second edge, a first tab extending from the first edge of the opening and perpendicular to the center section and, a second tab extending from the second edge of the opening and perpendicular to the center section. The opposing tabs are also staggered or offset in relation to one another. This particular connector embodiment is useful for connecting and installing purlins in a flat or horizontal position.

In yet another embodiment of the present connector device, the device comprises a U-shaped body having opposing side walls connected by a center section. The center section includes a center opening having a perimeter, with two opposing upright tabs on opposing sides of the perimeter of the center opening. This connector embodiment is also useful for connecting and installing purlins in a flat or horizontal position.

In a further embodiment, a connector device is provided for installing purlins in an upright or vertical position. The connector device comprises a base having opposing side walls connected by a center section, an opening within the center section, the opening having a first edge and a second edge, a first tab extending from the first edge of the opening and perpendicular to the center section and, a second tab extending from the second edge of the opening and perpendicular to the center section.

In another embodiment of the present disclosure, a method for constructing a roof structure is provided. The system includes the steps of providing a structural element for a constructing a roof including purlins and trusses, placing the purlins and trusses into position, securing the purlins and trusses together using a connector and installing a plurality of fasteners through the connector joining the structural elements, and lifting the engaged structural elements into position to create the roof structure.

It is, therefore, an advantage and objective of the present disclosure to provide a connector device and system for use in constructing the roof of a building quickly and easily.

It is further an advantage and objective of the present disclosure to provide an improved connector device and system for constructing the roof of a building wherein the roof has improved integrity and resistance to wind damage.

It is yet another advantage and objective of the present disclosure to provide an improved connector device and system for constructing a roof of a building wherein the majority of the construction of the roof structure can be accomplished at ground level.

Additional features and advantages of the present disclosure are described in, and will be apparent from, the detailed description of the presently preferred embodiments and from the drawings.

BRIEF DESCRIPTION OF THE DRAWINGS

The drawing figures depict one or more implementations in accord with the present concepts, by way of example only, not by way of limitations. In the figures, like reference numerals refer to the same or similar elements.

DETAILED DESCRIPTION

The present disclosure relates to a device and systems for constructing a structure. Specifically, the present disclosure relates to an improved device and system for constructing the roof of a building. The present disclosure relates to a securing or connecting device useful for connecting roof purlins to the truss or rafter in the construction of a roof for a building. In one embodiment, a purlin connector is provided to install a purlin on edge, or a vertical or upright position. In another embodiment, a purlin connector is provided for installing a purlin in a flat or horizontal position. Additionally, a method of constructing a roof using the connectors of the present disclosure is also provided.

An advantage of the various embodiments of the connector or bracket device of the present disclosure is that the connectors permit structural members, such as purlins, to be fully in contact with one another, meaning there is no material separation of the members. This feature allows for the structural members to maintain a consistent height, uniformity and stability without variation from structural member to structural member. The connectors are typically used where there is a connection or butt joint between members, which can inherently lead to instability. Use of the present connectors and the manner in which they are attached to the structural members avoids these issues.

The design of the present connector embodiments further permit fastening through the main body of the subject connector into the truss or rafter below. Specifically, the angle holes on the opposing sides of the main body of the connector means that the nails, or preferably screws, are installed at a 45 degree angle from both sides of the main body. Utilization of the tabs on the various connector embodiments further contribute to the secure installation afford by the present connectors. Furthermore, the use of the present connectors simplifies purlin installation because the connectors set the purlin into predetermined positions. Use of the present connectors permits two purlins to be installed in a straight line in end-to-end contact thereby eliminated overlap and splicing. Finally, the present connector embodiments allow for purlin joints to be offset from each other, thus offsetting load points, which provides further structural integrity to the overall roof structure.

The present disclosure further relates to a method for constructing a roof structure. The method includes the steps of providing a structural element for a constructing a roof including purlins and trusses, placing the purlins, rafters and/or trusses in position, securing the purlins, rafters and/or trusses together using an improved connector according to the present disclosure, and a plurality of fasteners installed through the connector, and finally lifting the engaged structural elements into position to create the roof structure.

Figure 1:
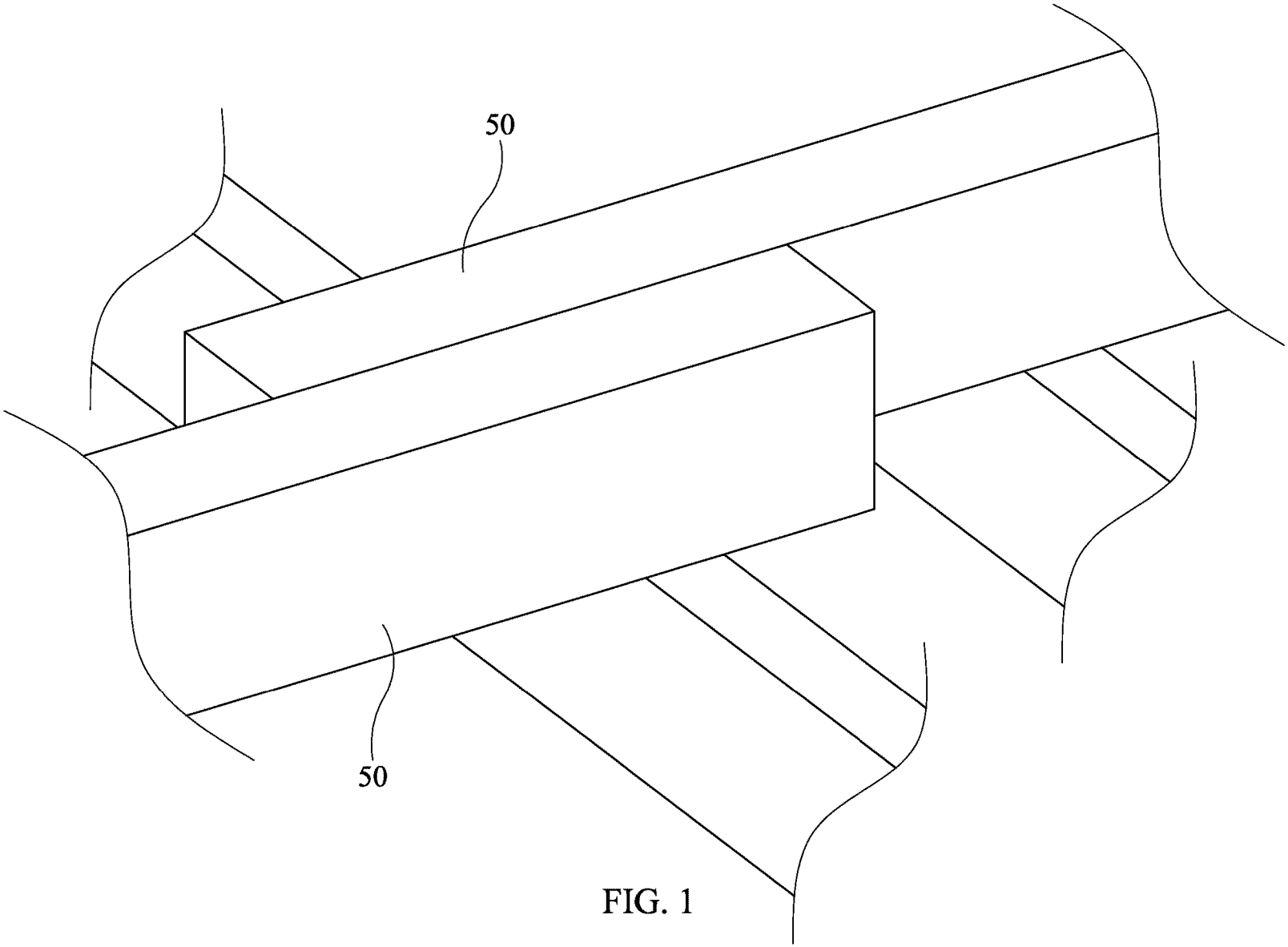
FIG. 1 illustrates a perspective view of a standard installation of purlins in an overlapping configuration.

Now referring to the figures, wherein like numerals refer to like parts, FIGS. 1-8 illustrate embodiments of connector devices, which are useful for constructing the roof of a structure. FIG. 1 illustrates a typical overlapping purling installation prior to use of the connectors of the present disclosure. FIGS. 2-4 and FIGS. 11-16 illustrate embodiments of connectors for securing purlins in an upright, vertical or "on edge" position. FIGS. 5-10 illustrate another embodiment of connectors for securing purlins in a flat or horizontal position.

As shown in FIG. 1, roof purlins 50 may be installed in an upright, vertical or "on edge" position in an overlapping manner. The current industry standard for fastening purlins in this position would be to drive a 6 inch 60 d ring shank nail lengthwise through the purlin and into the truss or rafter 52 below. However, securing the purlins in this manner can cause a weak and/or unsightly connection, and subject the resulting structure to the risk of wind damage and weaken the integrity of the roof structure. Additionally, overlapping the purlins 50 in the manner shown in FIG. 1, results in purlins that may be misaligned or staggered, which increases the difficulty of properly fastening the roof sheeting to the purlins and may contribute to issues with the overall integrity of the roof structure.

Figure 2:
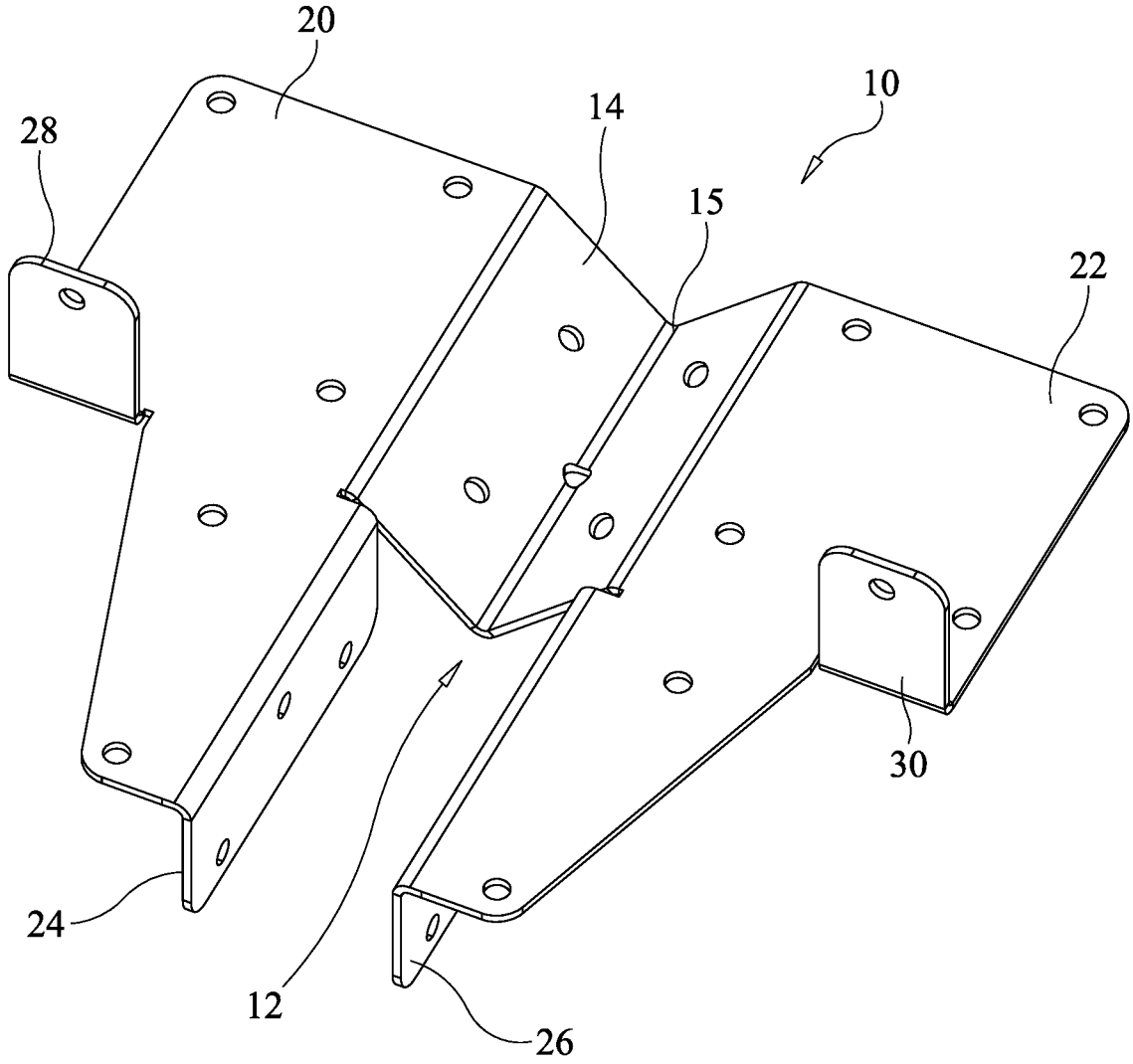
FIG. 2 illustrates a perspective view of an embodiment of a connector device for use in the installation of purlins for roof construction according to the present disclosure.
Figure 3:
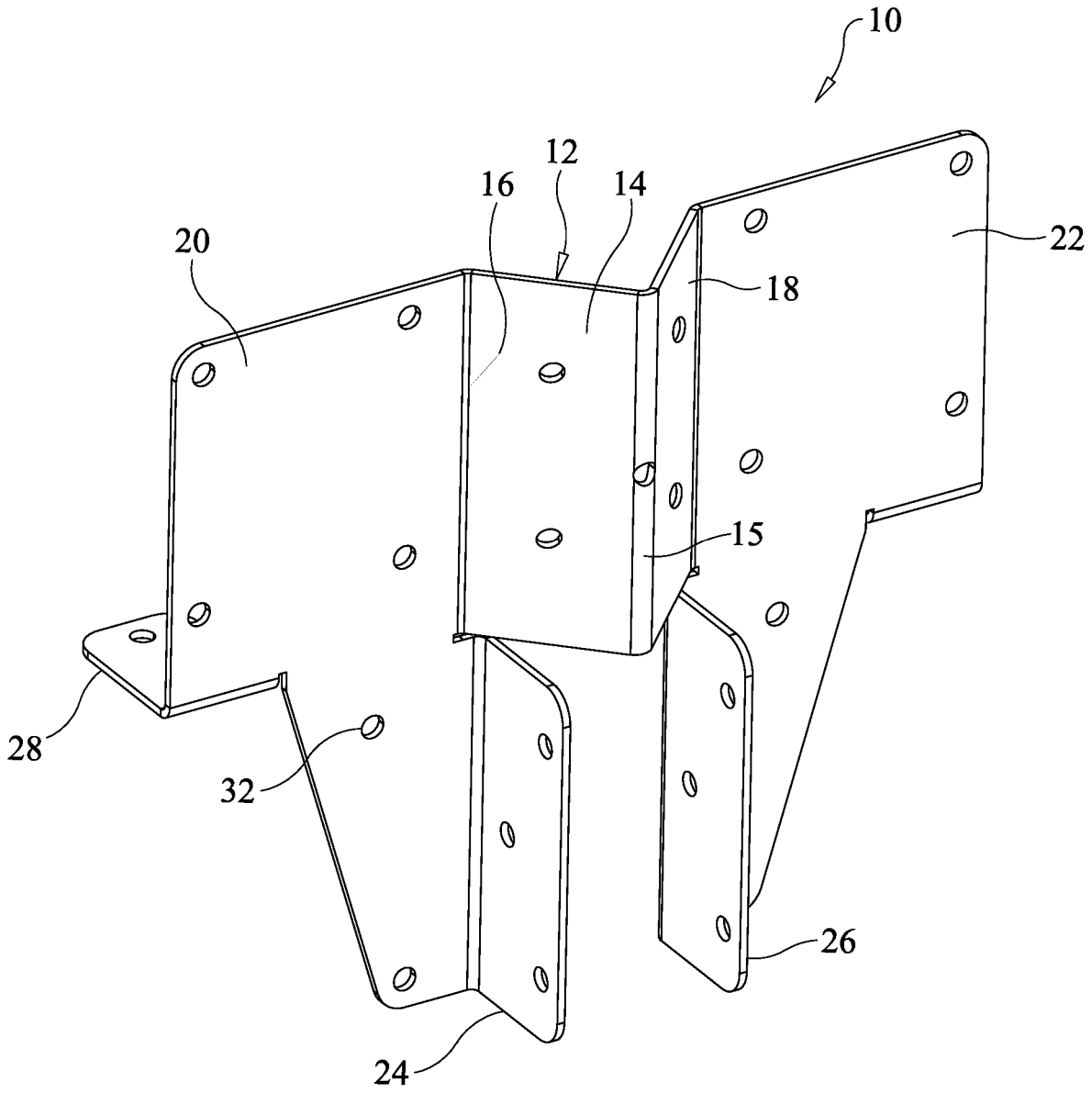
FIG. 3 illustrates another perspective view of the connector device of FIG. 2.
Figure 4:
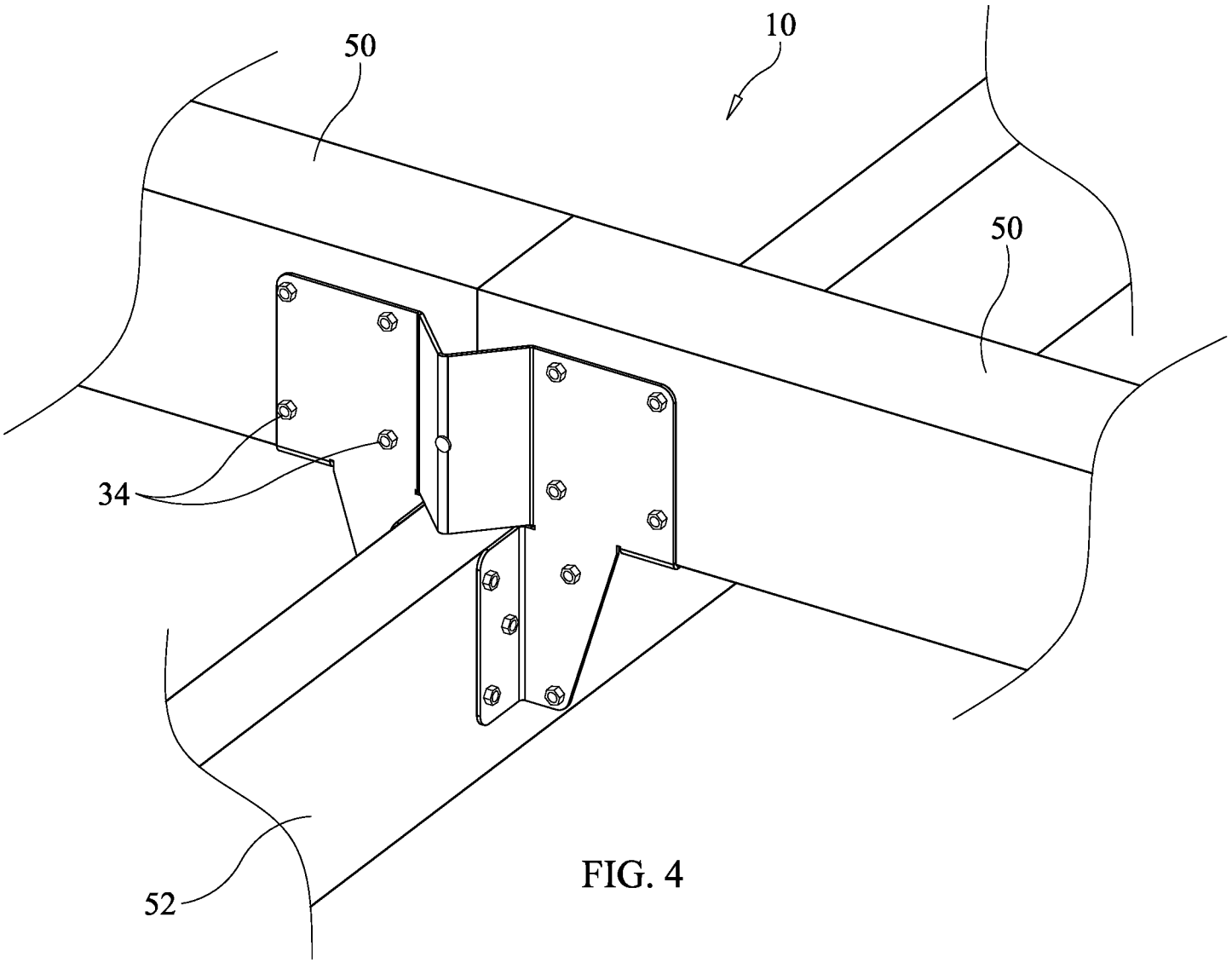
FIG. 4 illustrates a perspective view of the connector device of FIGS. 2 and 3 as used in the installations of purlins for roof construction according to the present disclosure.

FIGS. 2-4 illustrate an embodiment of a device in the form of a connector 10, which is useful for securing purlins 50 in the upright or vertical position and overcomes many of the issues recited above. FIGS. 2 and 3 illustrate perspective views of the embodiment of the connector 10, wherein the connector has a generally rectangular shape comprising a base 12 having a center section 14. The center section 14 includes a first longitudinal edge 16 and an opposing second longitudinal edge 18. As shown in FIGS. 2 and 3, the center section 14 includes a raised central ridge 15. A first side panel 20 is connected to the first longitudinal edge 16 of the center section, and a second opposing panel 22, is connected to the second longitudinal edge 18 of the center section. The two side panels 20, 22 are generally aligned in the same plane with each other.

The connector 10 further includes two opposing wings, a first wing 24 and a second wing 26. Each wing extends from a top of the center section 14 and are spaced apart from one another approximately the width of the raised center section. These opposing wings 24, 26 extend perpendicular in relation to the respective side panels 20, 22, and are configured to attach the purlins 50 using fasteners with a second structural member, such as a rafter 52.

Perpendicular tabs extend from a top edge of each of the first side panel 20 and the second side panel 22. Specifically, a first tab 28 extends perpendicular from a top of the first side panel 20, while a second tab 30 extends perpendicular from a top of the second side panel 22. wing section. These perpendicular tabs 28, 30 are configured for attachment to the underside of the purlins 50 using fasteners.

As shown in FIG. 4, the connector 10 is designed to secure the upright or vertical purlins 50 in an end-to-end, non-overlapping configuration. When the connector 10 is positioned on the upright purlins 50, the first and second wings 24, 26 of the connector are secured to the second structural member, such as rafter 52 or truss. The connector 50 is fastened through the plurality of holes 32 appearing throughout the body of the connecter with screws 34 as the fasteners rather than nails. Screws preserve the integrity of the wood and maintain the strength of the connection.

This particular connector 10, as well as all of the connectors of the present disclosure can be constructed using known methods from any suitable material, preferably steel, including galvanized steel for strength and longevity. Additionally, the connecters can be configured into various sizes suitable for the particular project, such as double ply trusses and rafters.

Figure 5:
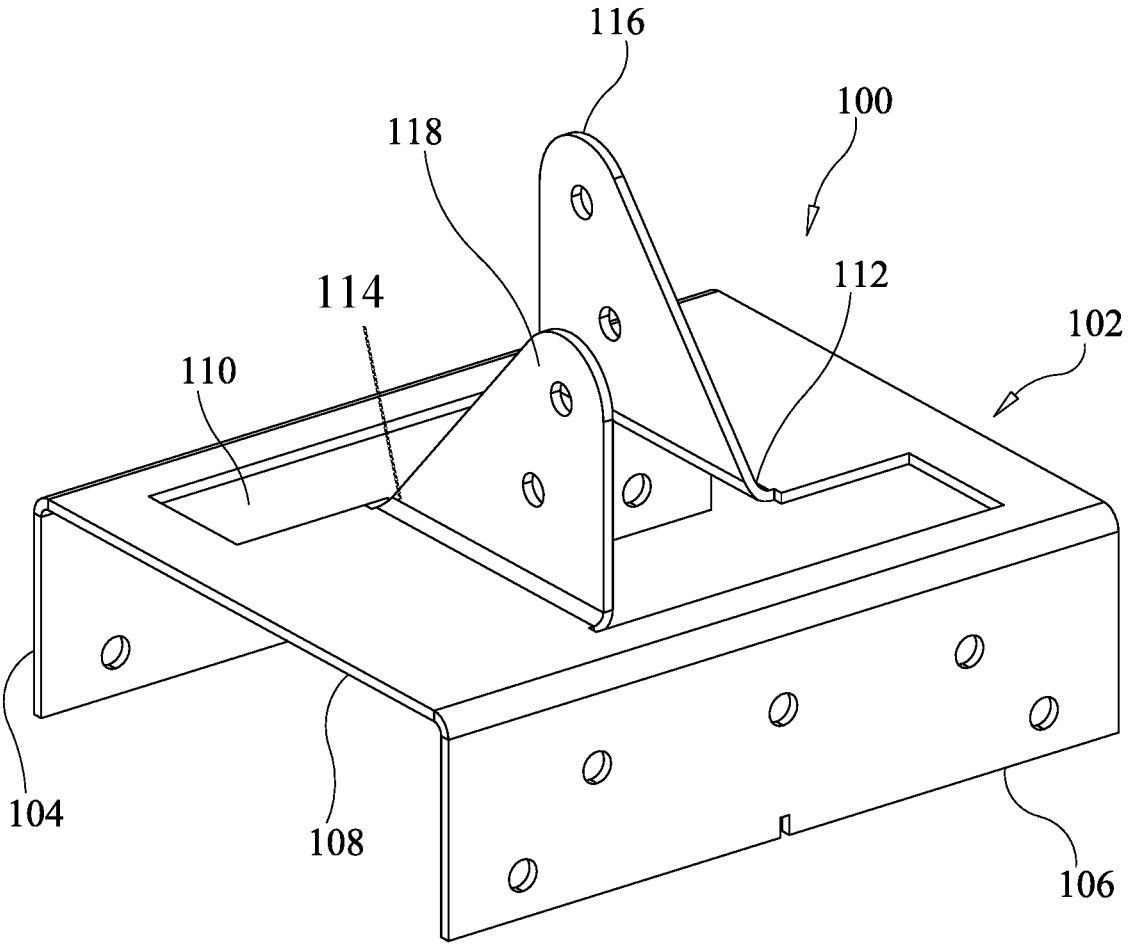
FIG. 5 illustrates a perspective view of another embodiment of a connector for use in the installation of purlins in the flat or horizontal position.
Figure 6:
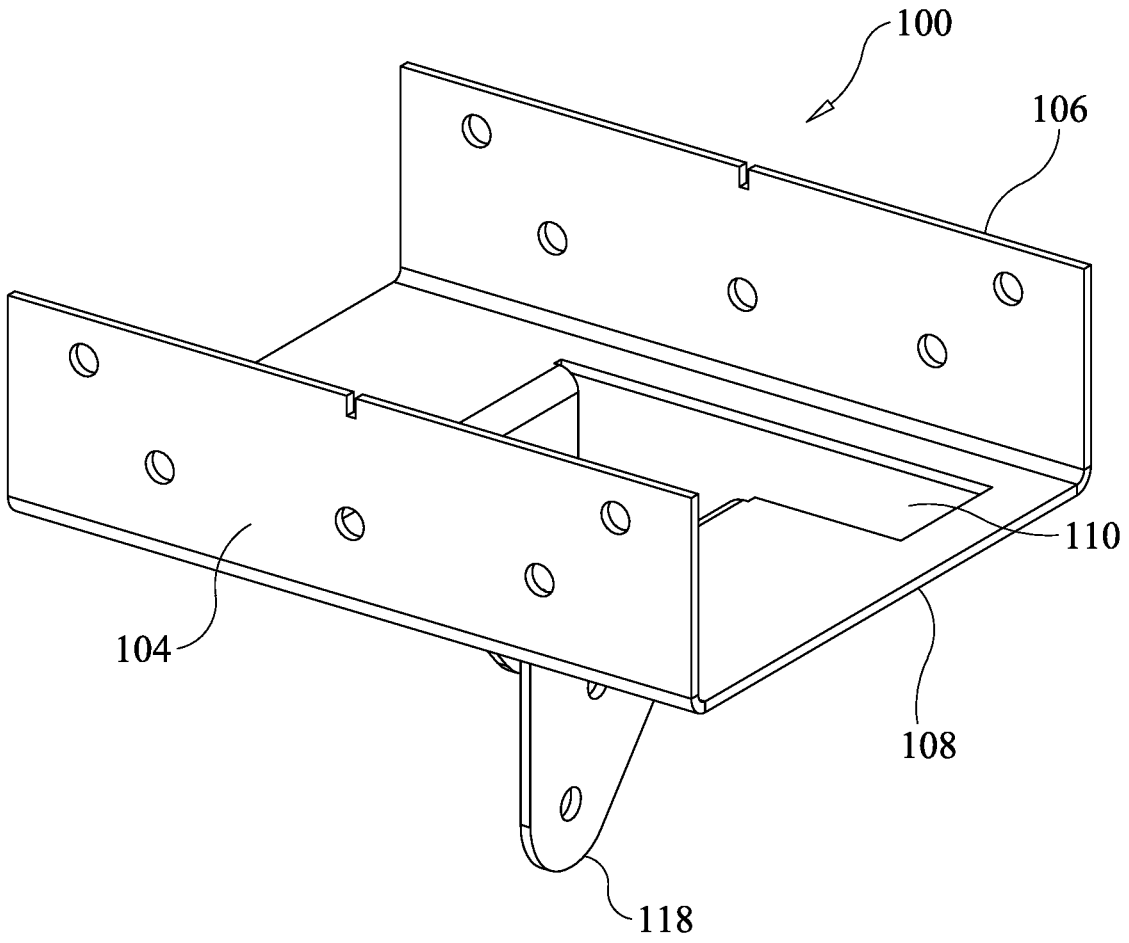
FIG. 6 illustrates another perspective view of the connector device of FIG. 5.
Figure 7:
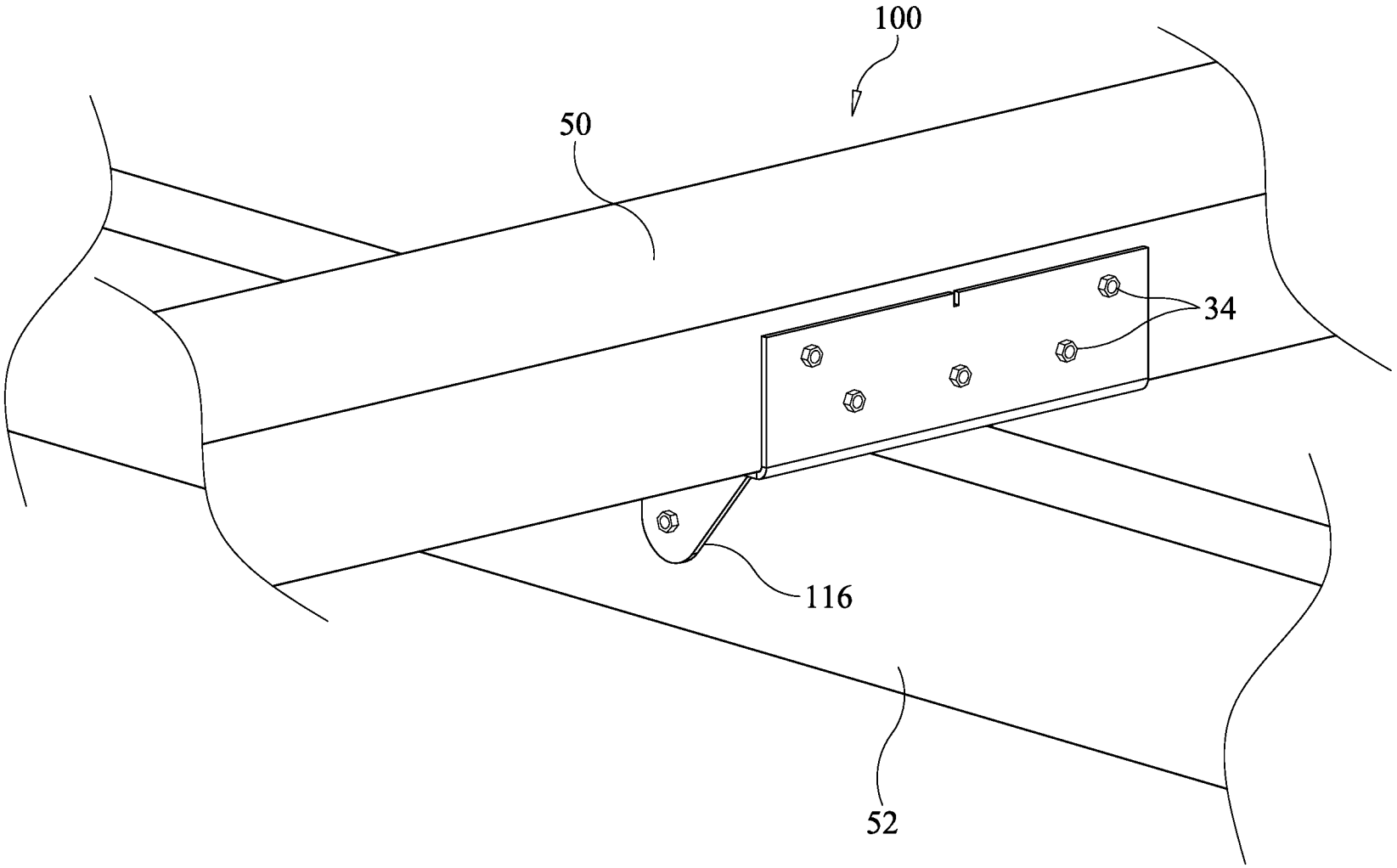
FIG. 7 illustrates a perspective view of the connector device of FIGS. 5 and 6 as used in the installations of purlins for roof construction according to the present disclosure.

FIGS. 5-7 illustrate another embodiment of a device in the form of a connector, which is useful for securing purlins 50 in the flat or horizontal position. As shown in FIG. 5, the connector 100 includes a base 102 having a first side wall 104 and an opposing second side wall 106 connected together by a center section 108. The center section 108 has a width sufficient to engage the width of the purlin 50 such that the purlin seats snug within the connector (FIG. 7). The center section 108 further includes an opening 110 therein. The opening 110 includes a first edge 112 and a second edge 114.

As shown in FIG. 5, the connector 100 further includes a pair of tabs, a first tab 116 and a second tab 118. The first tab 116 extends from the first edge 112 of the opening 110 in an upright or perpendicular position relative to the center section 108. The second tab 118 extends from the second edge 114 of the opening 110 also in an upright or perpendicular position relative to the center section 108. The opposing tabs 116, 118 are also in a staggered alignment in relation to one another and may extend inward toward the center of the opening 110. The opposing tabs 116, 118 are further spaced apart at a distance configured to match the width of the second structural element such that the tabs can be secured to either side of the second structural member. The connector 100 is then fastened into position using screws 34 through the plurality of holes 32 in the first and second side walls 104,106, and the opposing tabs 116, 118. Screws are preferred fasteners over nails for ease of installation and a stronger connection.

Figure 8:
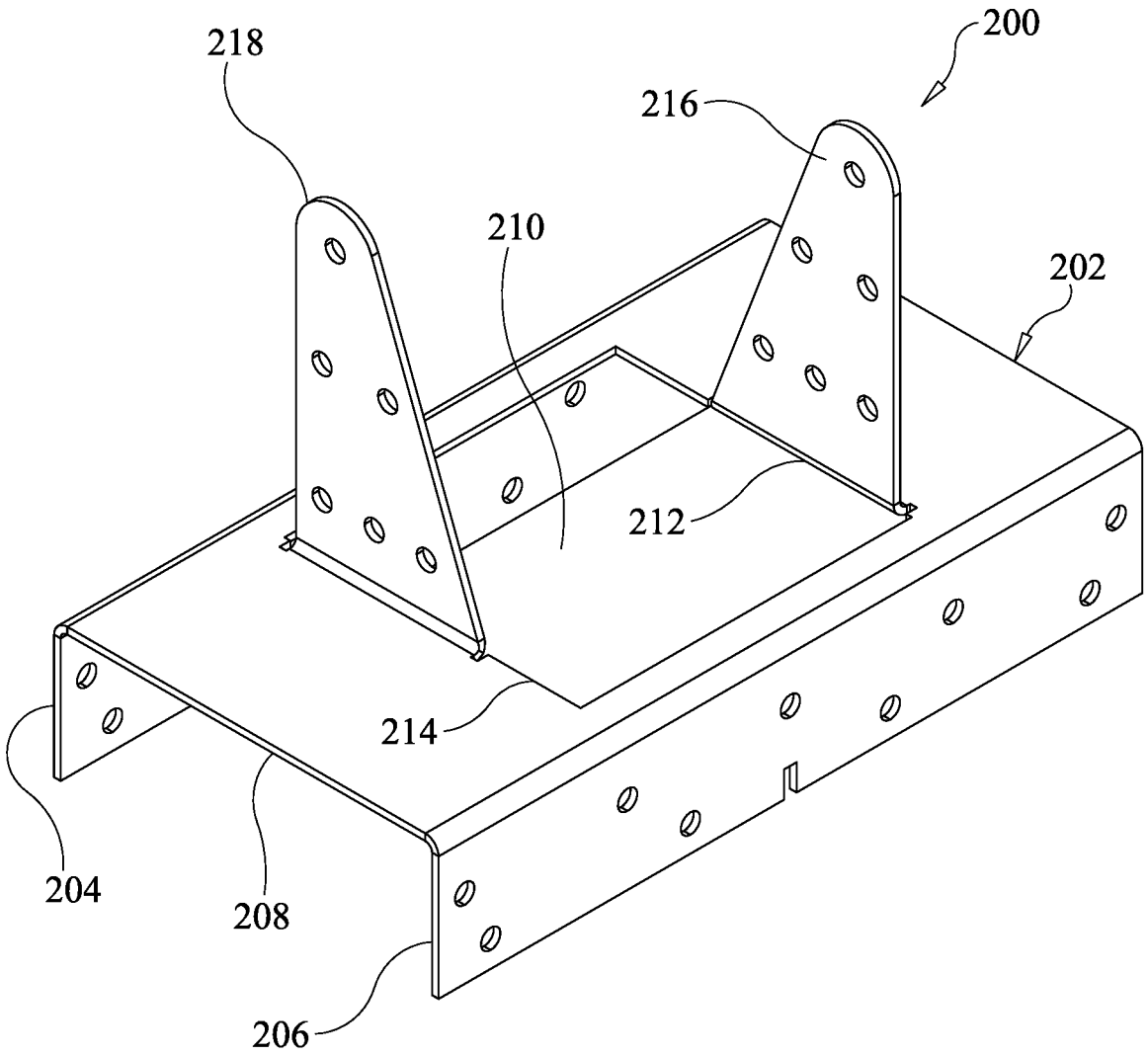
FIG. 8 illustrates a perspective view of yet another embodiment of a connector for use in the installation of purlins in the flat or horizontal position.
Figure 9:
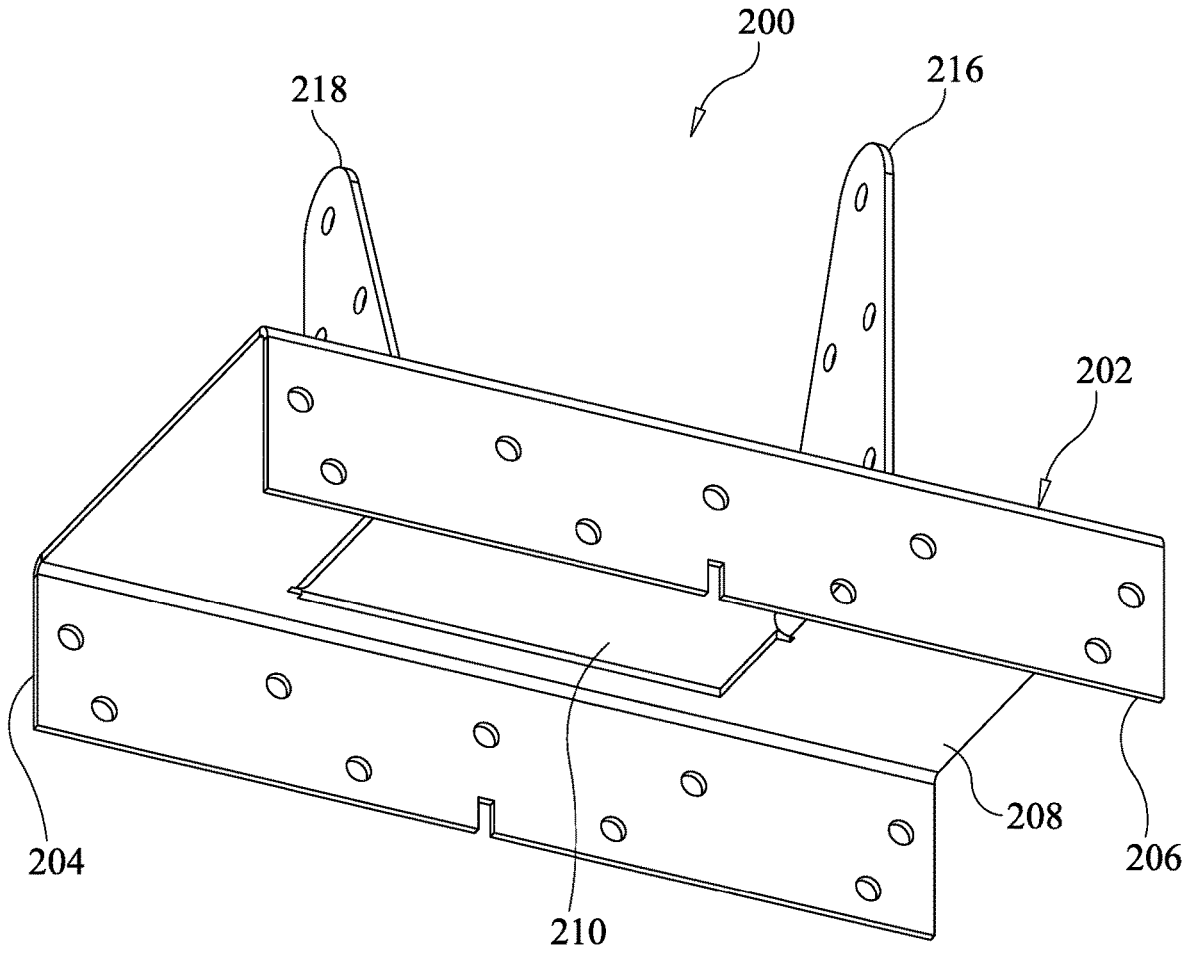
FIG. 9 illustrates another perspective view of the connector device of FIG. 8.
Figure 10:
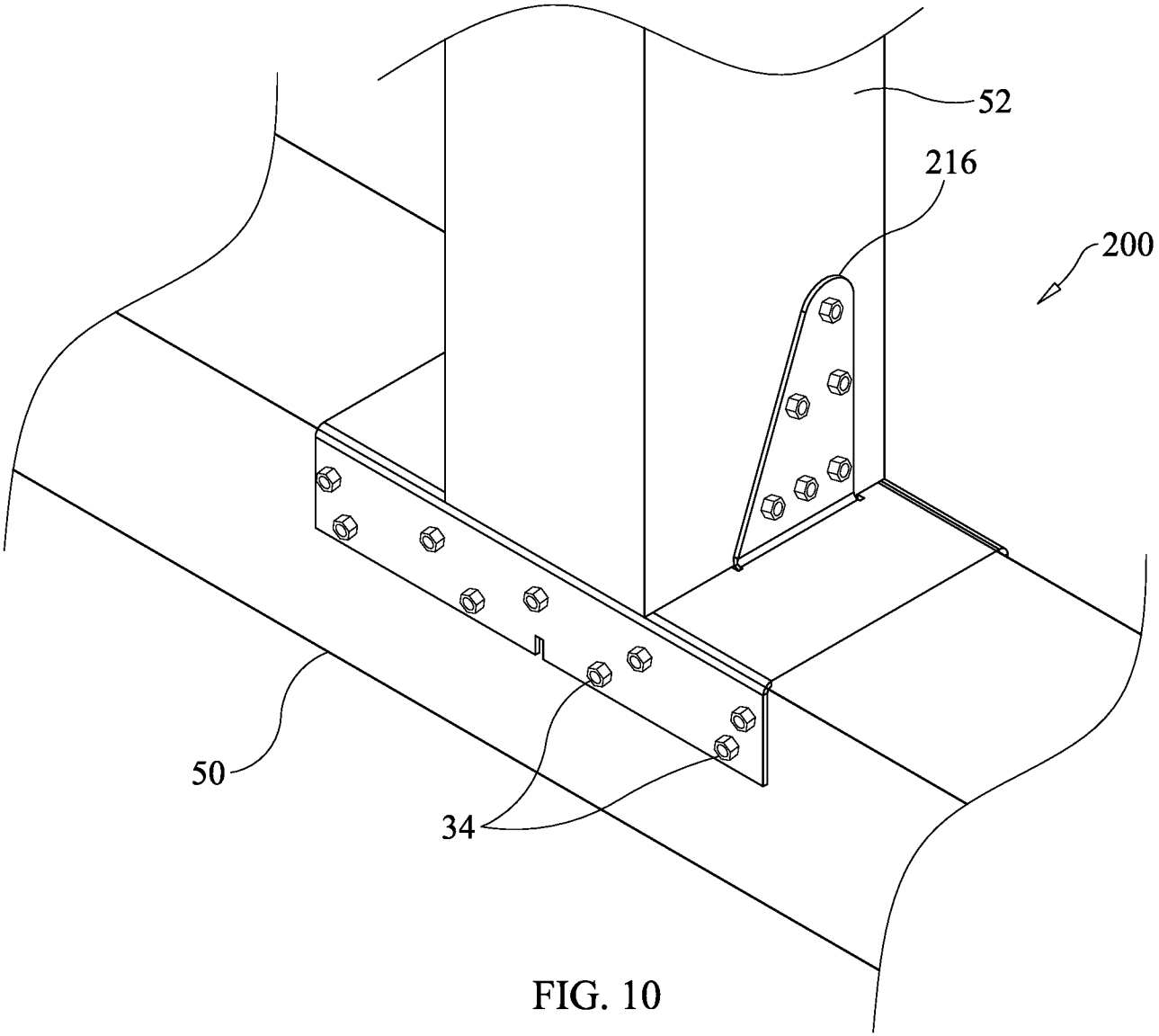
FIG. 10 illustrates a perspective view of the connector device of FIGS. 8 and 9 as used in the installations of purlins for roof construction according to the present disclosure.

FIGS. 8-10 illustrate yet another embodiment of a connector 200 for engagement with a purlin 50 in a flat or horizontal position and securing to a second structural member 52. The present connector 200 has a generally U-shape, formed from a base 202 having a first side wall 204 and an opposing second side wall 206 connected together by a center section 208. The center section 208 has a width configured to engage the width of the purlin 50 such that the purlin fits snug within the connector in the horizontal position. The center section 208 further includes an opening 210 therein. The opening 210 includes a first edge 212 and an opposing second edge 214.

The connector 200 includes a pair of tabs, a first tab 216 and a second tab 218. The first tab 216 extends from the first edge 212 of the opening 210 in an upright or perpendicular position in relation to the center section 208. The second tab 218 extends from the second edge 214 of the opening 210 also in an upright or perpendicular position to the center section 208. The opposing tabs 216, 218 are also in a staggered or offset alignment in relation to one another. The opposing tabs 216, 218 are further spaced apart from each other across the opening 210 such that they can be secured to either side of a second structural member such as a rafter or truss (FIG. 10).

FIGS. 7 and 10 illustrate the connectors 100, 200 in use. The purlin 50 is seated within the base 102, 202 of the respective connectors, where it is secured using a plurality of fasteners 34, preferably screws. The use of screws also reduces the risk of damage to the wood framing members and offers simple adjustability, if needed. Screws are also ideal fasteners because they offer more pull-out force while reducing damage to framing members, which in turn offers greater strength and wind load ratings. The opposing tabs 116, 118, 216, 218 (only one tab is shown) are further secured to the second structural member such as a rafter 52 in perpendicular arrangement with the purlin 50.

Figure 11:
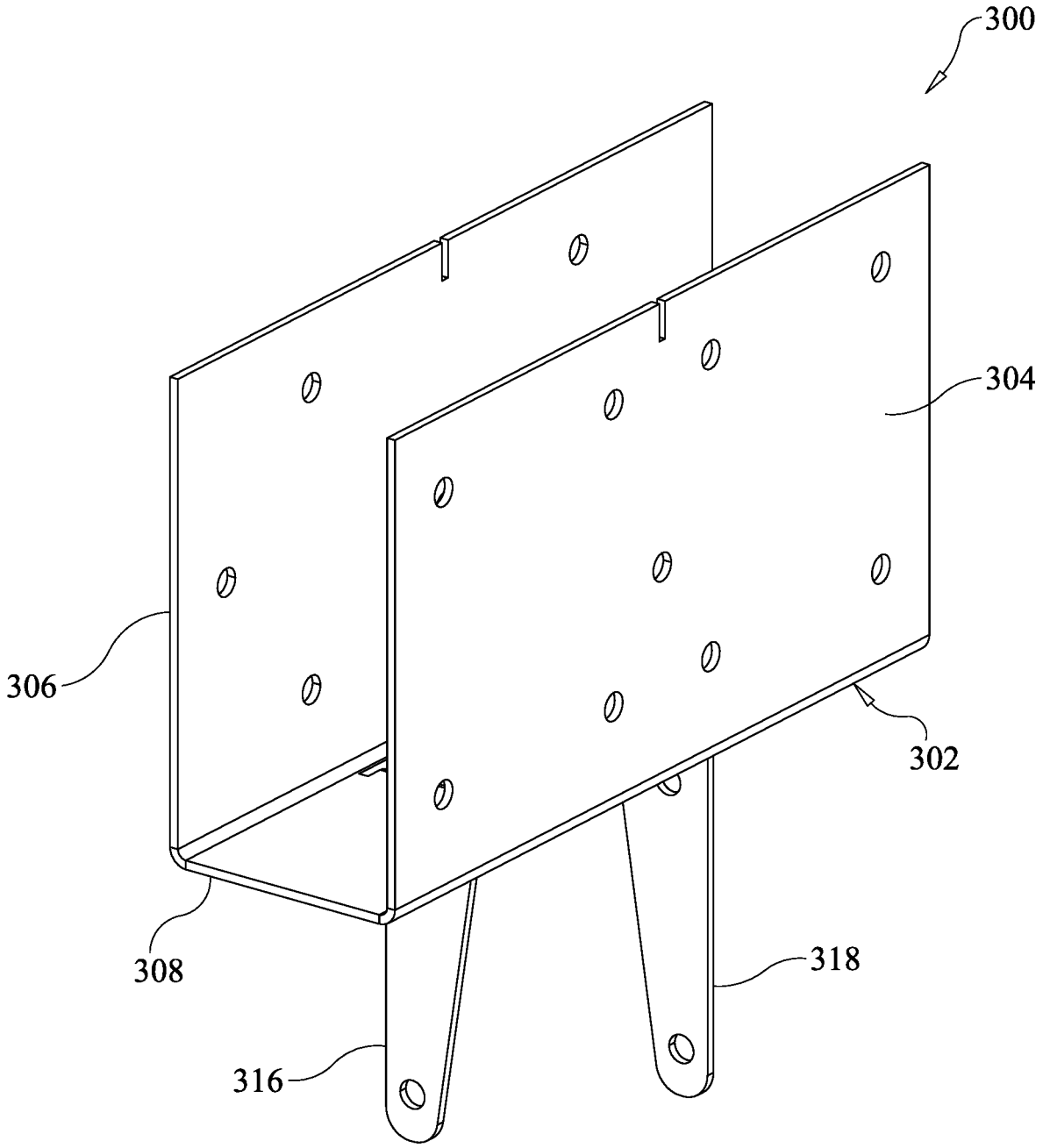
FIG. 11 illustrates a perspective view of yet another embodiment of a connector for use in the installation of purlins in the upright or vertical position.
Figure 12:
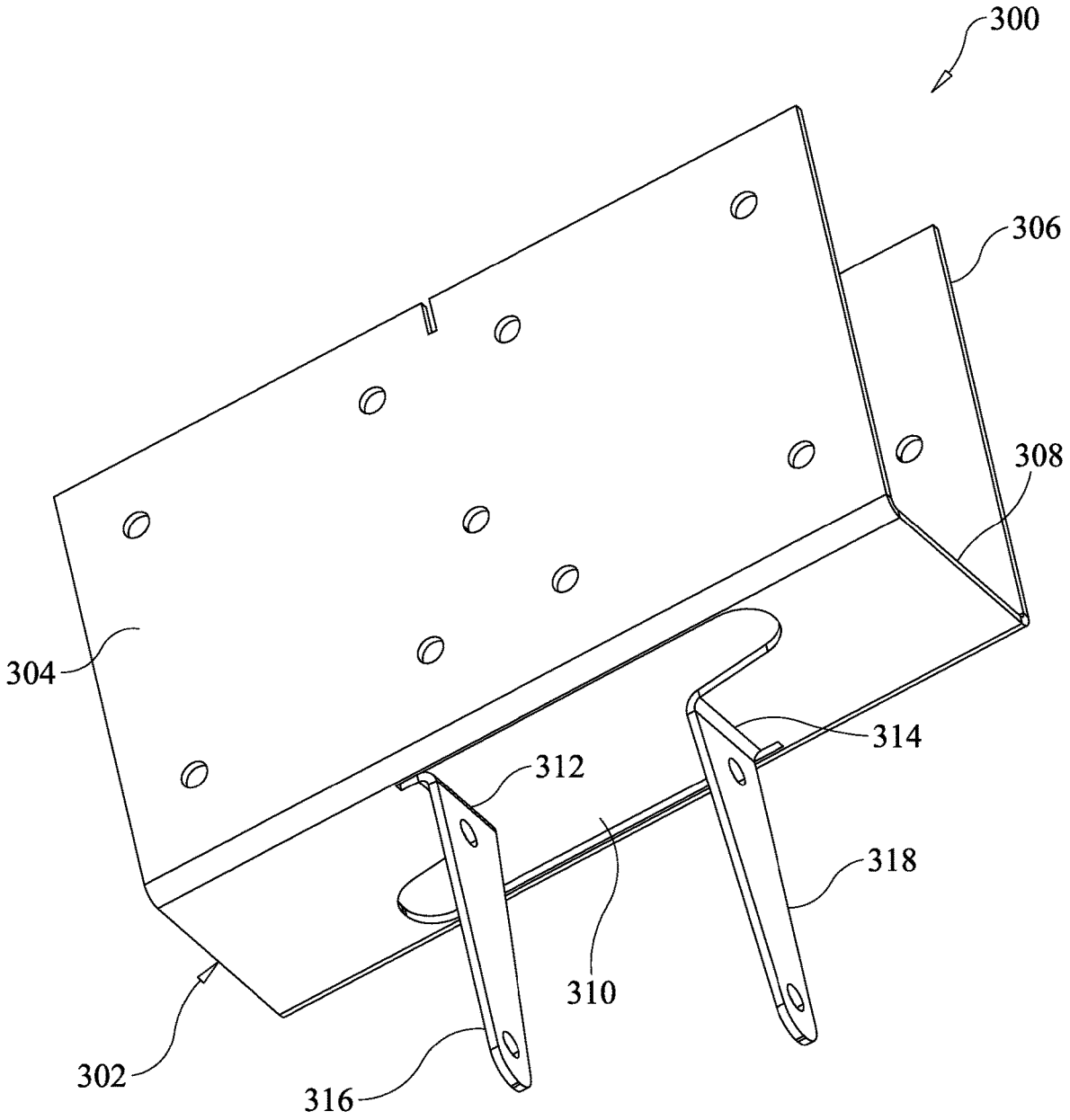
FIG. 12 illustrates another perspective view of the connector device of FIG. 11.
Figure 13:
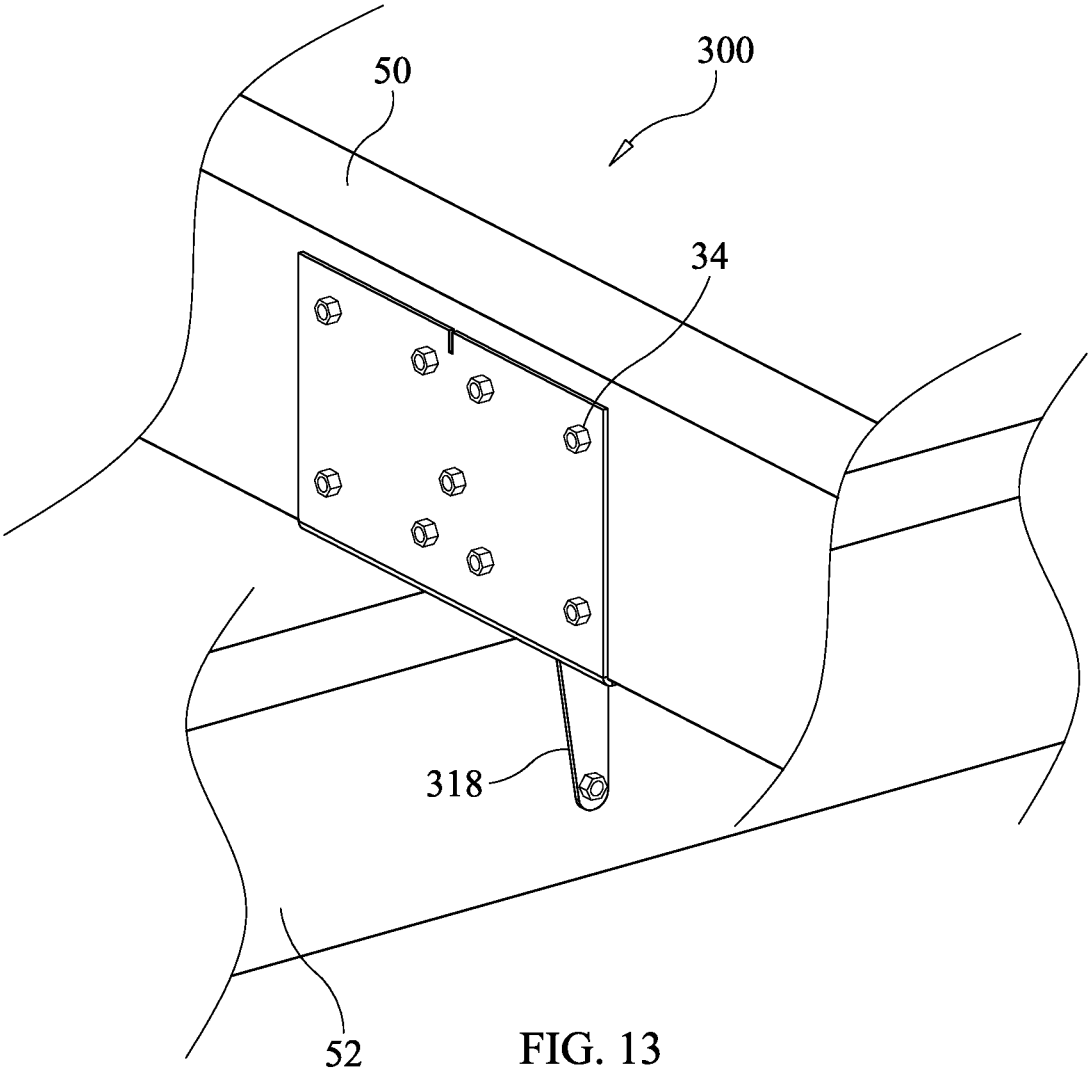
FIG. 13 illustrates a perspective view of the connector device of FIGS. 11 and 12 as used in the installations of purlins for roof construction according to the present disclosure.

FIGS. 11-13 illustrate yet further embodiments of a device in the form of a connector, which is useful for securing purlins 50 in the upright or vertical position. The connector 300 of FIG. 11 includes a base 302 having a first side wall 304 and an opposing second side wall 306 connected together by a center section 308. The first side wall 304 and the second side wall 306 each have a length greater than a width of the center section 308, wherein the first side wall and the second side wall are positioned along the longer length of the center section. The center section 308 has a width sufficient to engage the width of the purlin 50 in the upright position such that the purlin fits snug within the connector. The center section 308 further includes an opening 310 therein. The opening 310 includes a first perimeter edge 312 formed perpendicular to the length of the center section and a second perimeter edge 314 formed perpendicular to the length of the center section, wherein the first perimeter edge is in an offset alignment to the second perimeter edge.

As shown in FIGS. 11 and 12, the connector 300 includes a pair of tabs, a first tab 316 and a second tab 318. The first tab 316 extends from the first edge 312 of the opening 310 in an upright or perpendicular position to the center section 308. The second tab 318 extends from the second edge 314 of the opening 310 also in an upright or perpendicular position to the center section 308. The opposing tabs 316, 318 are also in a staggered or offset alignment in relation to one another and may extend inward toward the center of the opening 310. The opposing tabs 316, 318 are further spaced apart from each other at a sufficient distance such that they can be secured to either side of a second structural member such as a rafter or truss. The connector 300 is then fastened into position using a plurality of screws 34 as previously described.

Figure 14:
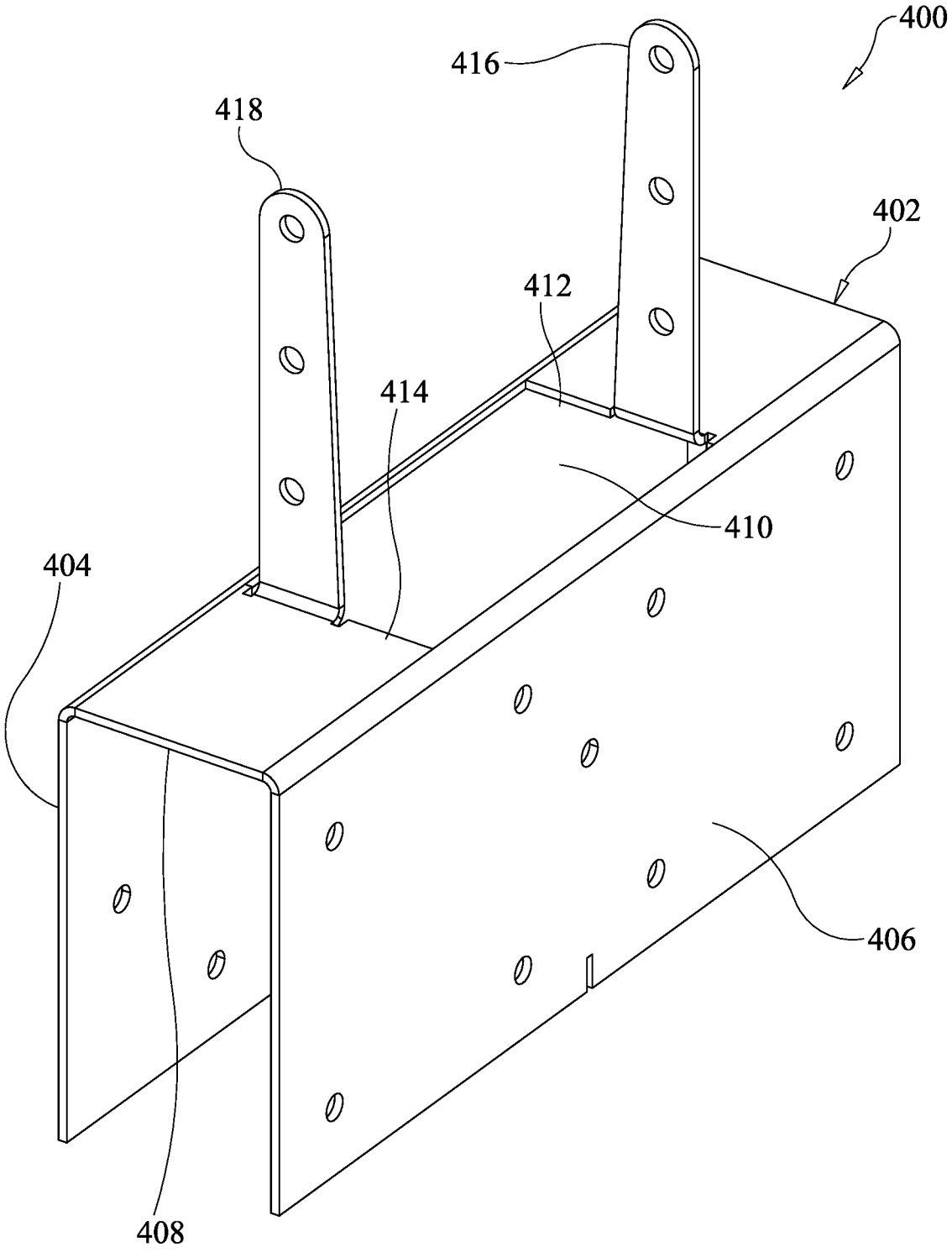
FIG. 14 illustrates a perspective view of yet another embodiment of a connector for use in the installation of purlins in the upright or vertical position.
Figure 15:
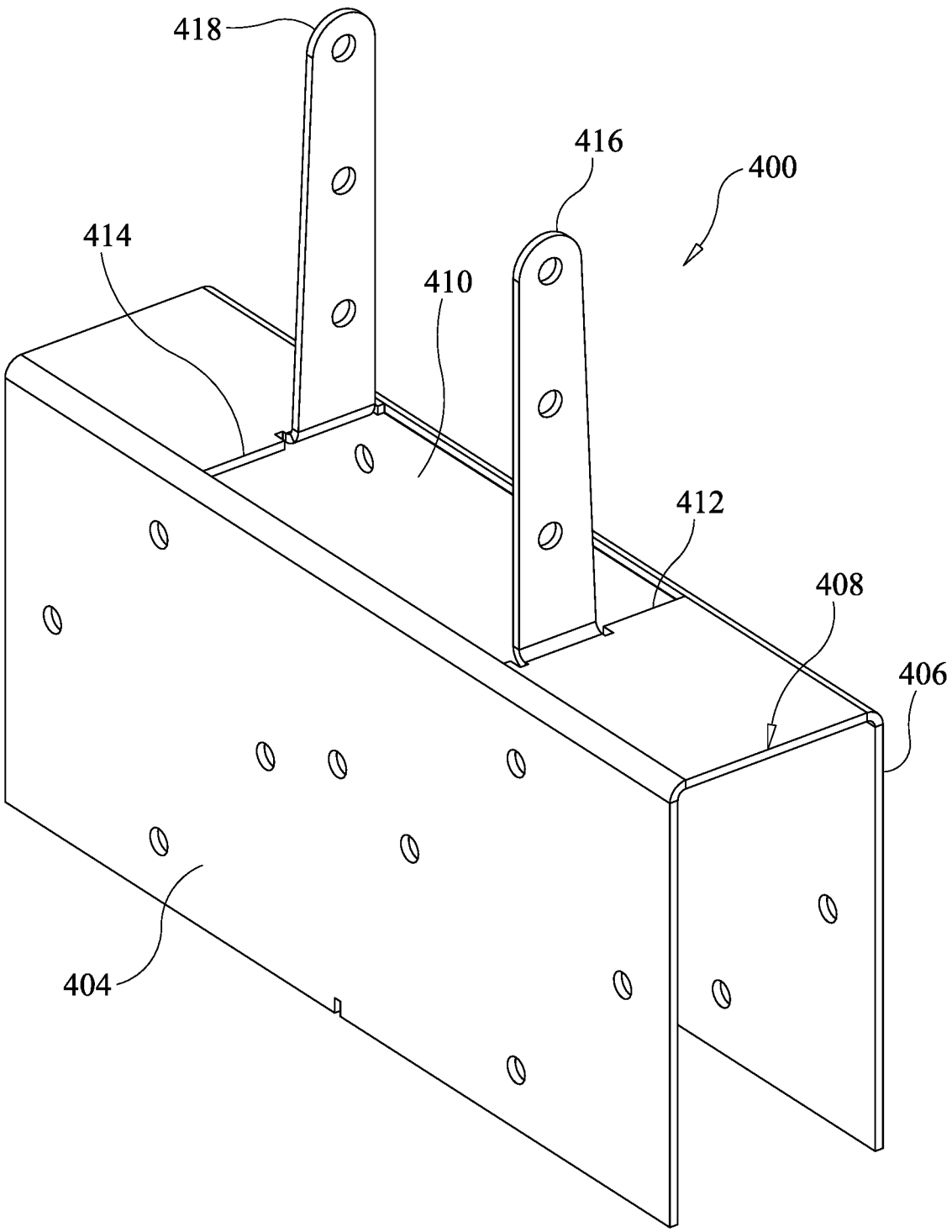
FIG. 15 illustrates another perspective view of the connector device of FIG. 14; and, FIG. 16 illustrates a perspective view of the connector device of FIGS. 14 and 15 as used in the installations of purlins for roof construction according to the present disclosure.
Figure 16:
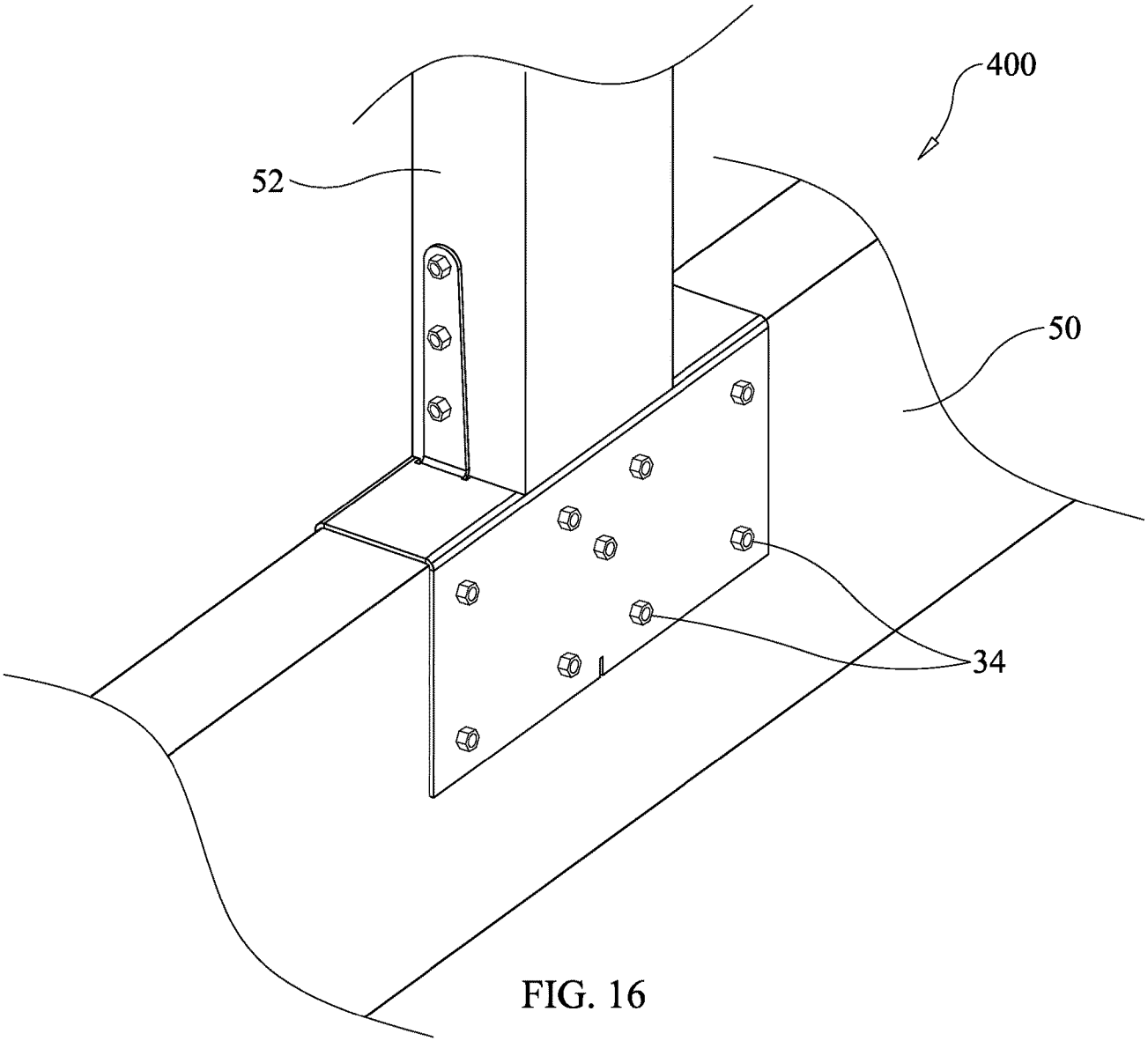

FIGS. 14-16 illustrate yet another embodiment of a connector 400 for engagement with a purlin in an upright or vertical position and securing to a second structural member. The present connector 400 has substantially a U-shape, formed from a base 402 having a first side wall 404 and a second side wall 406 connected together by a center section 408. The center section 408 has a width sufficient to engage the width of the purlin 50 such that the purlin fits snug within the connector. The center section 408 further includes an opening 410 therein. The opening 410 includes a first edge 412 and a second edge 414.

The connector 400 includes a pair of tabs, a first tab 416 and a second tab 418. The first tab 416 extends from the first edge 412 of the opening 410 in an upright or perpendicular position to the center section 408. The second tab 418 extends from the second edge 414 of the opening 410 also in an upright or perpendicular position to the center section 408. The opposing tabs 416, 418 are also in a staggered alignment in relation to one another. The opposing tabs 416, 418 are further spaced apart from each other such that they can be secured to either side of a second structural member such as a rafter or truss using screws 34 as previously described.

The connectors 10, 100, 200, 300, 400 shown in present disclosure allows the purlins 50 to be joined together at the joint or connection point of the rafter or truss without the risk of splitting the boards by offering a larger area where the boards can be joined. This in turn, greatly reduces the risk of splitting or splintering of the wood purlins. Additionally, the connectors can be installed at multiple purlin locations, including the lap, middle of the purlin, and where an end wall overhang is utilized. The present connectors are also suitable for use on the end of the building where an overhang may be present. These connectors offer greater resistance to pull-out and reduce the risk of total roof failure.

The present disclosure further includes a method for construction of a roof structure. The method includes the steps of providing a structural element for a constructing a roof including purlins and trusses, placing the purlins and trusses in position, securing the purlins and trusses together using a connector and a plurality of fasteners installed through the connector, and lifting the connected structural elements into position to create the roof structure.

An advantage of using the present connectors and method is that it permits construction of all or a portion of a roof structure prior to lifting the roof onto the building structure.

In this manner, the connectors can be installed onto the truss or rafter while still on the ground and prior to truss installation, thereby decreasing the difficulty of installation while providing a safer working environment. As the post frame industry continues to seek entry into the residential and commercial markets, there will be the need for meeting increased wind loadings. The present connectors are designed to assist with meeting these increased loadings by reinforcing the roof connection points that are typically most prone to failure.

It should be noted that various changes and modifications to the presently preferred embodiments described herein will be apparent to those skilled in the art. Such changes and modifications may be made without departing from the spirit and scope of the present invention and without diminishing its attendant advantages. Further, references throughout the specification to "the invention" are nonlimiting, and it should be noted that claim limitations presented herein are not meant to describe the invention as a whole. Moreover, the invention illustratively disclosed herein suitably may be practiced in the absence of any element which is not specifically disclosed herein.

I claim:

1. A connector for joining structural elements together for constructing a roof of a building, the connector comprising:

a base having a center section between a first side wall and an opposing second side wall, wherein the center section has a length longer than a width of the center section, wherein the first side wall and the second side wall are positioned along the longer length of the center section;

an opening within the center section, the opening having a first perimeter edge formed perpendicular to the length of the center section and an opposing second perimeter edge formed perpendicular to the length of the center section, wherein the first perimeter edge is in an offset alignment to the second perimeter edge;

a first tab extending perpendicular from the first perimeter edge of the opening and perpendicular to the length of the center section and the first side wall, wherein the first tab extends outward in an opposing direction from the first side wall; and, a second tab opposing the first tab and extending perpendicular from the second perimeter edge of the opening and perpendicular to the length of the center section and the second side wall, wherein the second tab extends outward in an opposing direction from the second side wall;

and wherein the first tab is in an offset alignment to the second tab.

2. The connector of claim 1, wherein the first side wall and the second side wall extend outward from and perpendicular to the center section.

3. The connector of claim 2, wherein the base has a U-shape formed by the center section, the first side wall and the second side wall.

4. The connector of claim 1, wherein the base is configured for engaging a first structural element in a horizontal position between the first side wall and the opposing second side wall.

5. The connector of claim 1, wherein the first tab and the second tab are configured for engaging a second structural element in a horizontal position and across the width of the center section between the first tab and the second tab.

6. The connector of claim 1, wherein the first tab and the second tab are configured for engaging a second structural element in a vertical position between the first tab and the second tab.

7. The connector of claim 1, wherein the base is configured for engaging a first structural element in a first position and the first tab and second tab are configured for engaging a second structural element in a second position.

8. The connector of claim 1, wherein the first side wall and the second side wall each have a length longer than the width of the center section.

9. The connector of claim 1, wherein the first side wall and the second side wall have a plurality of fastener holes.

10. The connector of claim 9, wherein the first side wall includes a first pattern of fastener holes and the second side wall includes a second pattern of fastener holes.

11. The connector of claim 10 wherein the first pattern of fastener holes is distinct from the second pattern of fastener holes.

* * * * *